United States Patent [19]

Pohl

[11] 4,150,558

[45] Apr. 24, 1979

[54] METHOD FOR FORMING A VARIABLE RESTRICTOR

[75] Inventor: Walter J. Pohl, Anchorage, Ky.

[73] Assignee: General Electric Company, Louisville, Ky.

[21] Appl. No.: 848,538

[22] Filed: Nov. 4, 1977

[51] Int. Cl.[2] ..... B21D 51/16; B21D 53/06

[52] U.S. Cl. ..... 72/367; 29/157 R; 29/407; 62/511; 138/40; 138/45

[58] Field of Search ..... 29/157 R, 157 A, 407; 62/527, 511, 504; 138/45, 44, 40; 72/367, 57

[56] References Cited

U.S. PATENT DOCUMENTS

| | | | |
|---|---|---|---|
| 815,192 | 3/1906 | Mercer | 138/45 |
| 2,225,513 | 12/1940 | Summers | 29/157 R |
| 2,227,537 | 1/1941 | Dasher | 138/46 |
| 2,422,921 | 6/1947 | Nier et al. | 138/45 |
| 2,532,452 | 12/1950 | Hoesel | 138/45 |
| 2,744,429 | 5/1956 | Seely | 29/157 R |
| 2,909,196 | 10/1959 | Jeffreys, Jr. | 138/44 |
| 3,017,903 | 1/1962 | Steffens | 138/45 |
| 3,598,288 | 8/1971 | Poegate | 222/70 |
| 3,967,489 | 7/1976 | Pohl et al. | 29/157 R |
| 4,086,782 | 5/1978 | Forsberg | 62/504 |

FOREIGN PATENT DOCUMENTS

| | | | |
|---|---|---|---|
| 146223 | 6/1951 | Australia | 62/511 |

*Primary Examiner*—C. W. Lanham
*Assistant Examiner*—Daniel C. Crane
*Attorney, Agent, or Firm*—Frank P. Giacalone; Radford M. Reams

[57] ABSTRACT

The present invention provides a restrictor for use in a refrigeration system including the method of adapting its use to the system and more particularly to a restrictor that is formed by providing a flattened portion of tubing that is bent to establish a substantially U-shaped restrictor having diverging leg members connected at their apex by an arcuate segment. Means are provided for moving at least one of the leg members relative to the other so that the diameter of the arcuate segment is altered. Altering the diameter of the arcuate segment causes the cross-sectional area of the restrictor passageway in the segment area to change and, accordingly, the refrigerant flow through the restrictor is effectively adjusted to optimize the refrigeration system efficiency.

2 Claims, 6 Drawing Figures

METHOD FOR FORMING A VARIABLE RESTRICTOR

BACKGROUND OF THE INVENTION

The present invention relates generally to capillary or restrictors employed in refrigeration systems, and more particularly to a restrictor that can be adjusted to alter the refrigerant flow therethrough. It is desirable that a restrictor having a precise refrigerant flow be designed for a specific refrigeration system so as to provide the specific flow characteristics required by the system.

In employing capillary tubes as restrictors between the high pressure and low pressure sides of the refrigeration system, the passageway through the restrictor must be specifically designed and sized for the system and cannot be altered by a service man in the field if operating conditions warrant it. The alternative in many instances is to replace it with another restrictor also having a predetermined flow characteristic.

It is also desirable in refrigerator systems that the restrictors be designed so that saturation conditions are maintained throughout the entire evaporator while permitting the suction line to superheat in order to prevent flooding of the compressor.

In U.S. Pat. No. 3,967,489-Pohl, assigned to the General Electric Company, the assignee of the present invention, a restrictor is provided that is shaped while the flow fluid passing therethrough is measured so that a restrictor having a specific predetermined flow characteristic is provided. The shaped restrictor is then installed as part of a refrigeration system requiring that particular flow characteristic. In practice, however, the refrigeration system including the restrictor having the predetermined flow characteristics as employed in a particular self-contained air conditioner might not operate at its optimum level after the unit is stabilized under full load conditions. It may be advantageous to provide restrictors that are capable of varying the refrigerant flow between the condenser and evaporator relative to the operating conditions of the system. This is especially true when the same refrigeration system is employed in air conditioning units having air flow systems that provide different air flow characteristics from one unit to the next. Adjustable restrictors are also utilized to provide refrigeration systems that function efficiently over a wide range of ambient temperatures.

In some instances expansion valves are employed that automatically adjust the flow of liquid refrigerant to the evaporator to balance compressor pumping capacity during a wide range of conditions. However, the devices are expensive in that the operating components are generally machined to function at relatively close tolerances.

U.S. Pat. No. 2,227,537 provides an elongated passage formed of a long strip of thin metal which is provided with a groove. The strip may then be folded upon itself, or a second sheet of metal may be placed at the edges to isolate the passage, and then rolled into a spiral. The initial restriction provided in the passage may be controlled by varying the radius of curvature and the amount of curl of the assembled sheet metal portions.

U.S. Pat. No. 2,532,452—Holsel provides a coupling including a ferrule having an initial bore that slip fits over the tube. Securing the coupling effectively compresses the ferrule and reduces the initial bore of the ferrule. This reduction in the initial bore squeezes the outside diameter of the tube at that part and accordingly reduces the passageway of the tube.

SUMMARY OF THE INVENTION

By this invention there is provided a restrictor or capillary and the method of forming a capillary tube for use in a refrigeration system including forming a length of tubing longitudinally into a preselected configuration so that the free ends thereof are arranged to connect with the refrigeration system. A portion of the tubing intermediate the free ends is placed in a forming means and one of said free ends is connected to a source of constant pressure through a control for measuring the pressure passing through the tubing.

The portion of tubing in the forming means is squeezed or flattened at a first speed until the tubing reaches an intermediate predetermined restriction. The flattened portion is then bent to provide a generally U-shaped restriction having leg members diverging from an arcuate apex segment. The U-shaped restrictor is connected in refrigerant flow arrangement to complete the closed refrigeration system. At least one of the leg members of the restrictor is moved relative to the other to change the diameter of at least the arcuate portion until the restriction in the arcuate portion causes refrigerant passing therethrough to reach a final predetermined pressure.

An object of the present invention is to provide a variable restrictor for use in fine tuning a refrigeration system at the rated capacity, and alternatively to control the flow of refrigerant relative to load conditions imposed on the system.

DESCRIPTION OF THE PREFERRED EMBODIMENT

Figure 1:
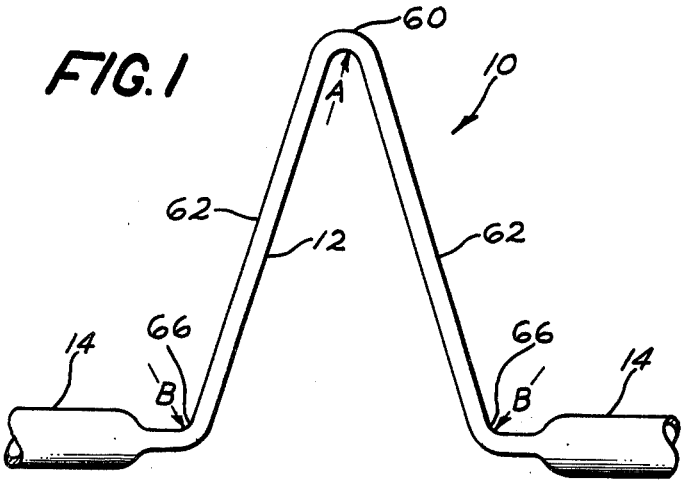
FIG. 1 is an elevational view of the restrictor fabricated in accordance with the present invention.
Figure 2:
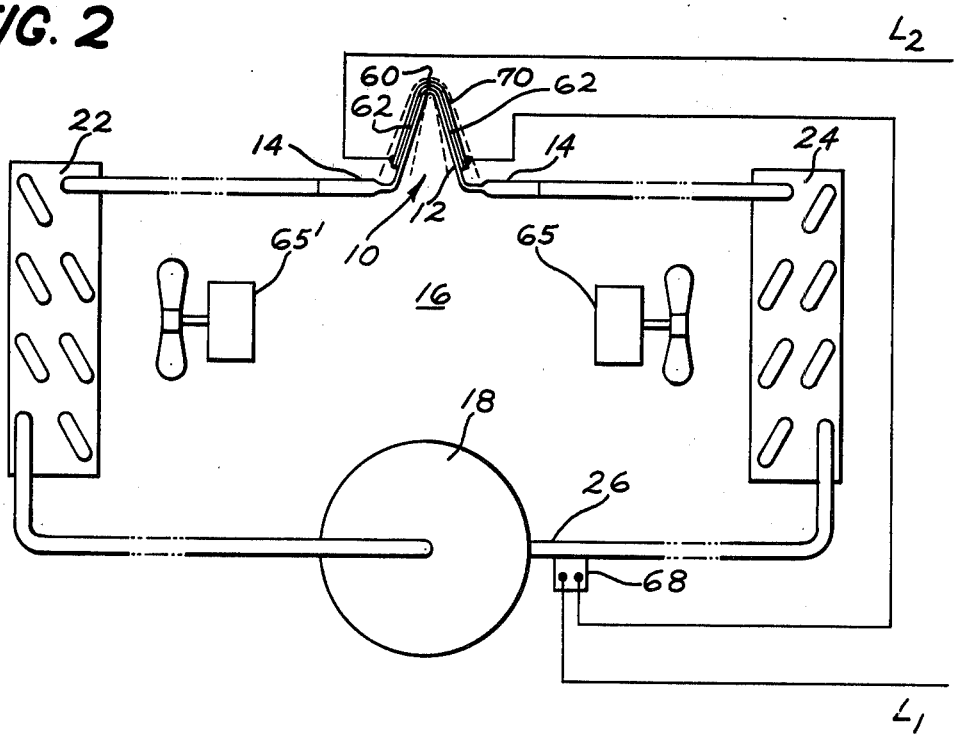
FIG. 2 is a schematic of a refrigeration system incorporating one embodiment of the present restrictor.

Referring to the drawings and more particularly to FIG. 1, there is shown a capillary or restrictor tube 10 formed in accordance with the method of the present invention. The finished or completed tube 10 consists of a collapsed or squeezed restriction portion 12 which, as will be explained hereinafter, effectively controls the flow of refrigerant therethrough and end portions 14 that are joined to the refrigeration system 16 as shown in FIG. 2.

The refrigeration system 16 includes a compressor 18 which pumps hot refrigerant in high pressure gaseous form through a discharge line 20 into a condenser 22, in which the hot gas is cooled to a degree at which it emerges from the condenser 22 in a high pressure liquid form. The high pressure liquid refrigerant from the condenser 22 passes through the restricted passageway of portion 12 of restrictor 10. The restrictor 10 discharges low pressure liquid refrigerant into the evaporator 24 where it vaporizes and absorbs heat of vaporization and is then returned in gaseous form through a suction line 26 to the low pressure side of compressor 18. As will be explained fully hereinafter, the present invention provides for adjusting refrigerant flow through the restrictor to provide controlled suction refrigerant superheat.

The tubing 10 employed in fabricating the present method is a standard stock or off-the-shelf item that has an outside diameter of approximately ¼ inch (6.35 MM), and a wall thickness of approximately 0.050 inch (1.39 MM). It should be noted that tubing having other dimensions may be employed; however, the following method of the present embodiment was carried out with the above-dimensioned tube stock.

The present method of forming the capillary and restriction may be effected by any number of mechanisms and accordingly the present description and drawings are intended to teach the present invention to one skilled in the art.

Figure 3:
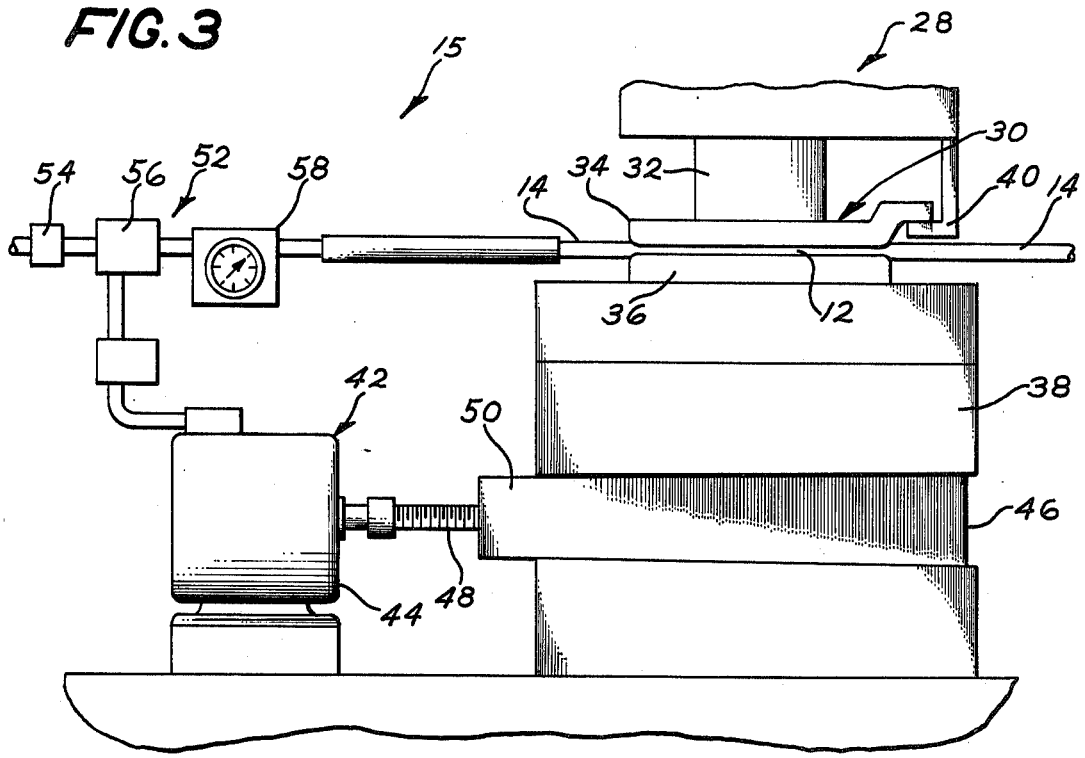
FIG. 3 is a schematic of a mechanism used in fabricating the present restrictor.

One form of mechanism 15 for carrying out the steps of the method is shown in FIG. 3 and is similar to the one disclosed in U.S. Pat. No. 3,967,489 assigned to General Electric Company, the assignee of the present invention. The mechanism 15 may include a two-step forming press 28. The forming press 28 includes a primary or high-speed section 30 having a forming ram 32 on which is mounted a die plate 34. The plate 34 is adapted to cooperatively engage a matching die 36 supported on a stationary table or anvil 38.

A stop means 40 is positioned so as to be engaged by the ram 32 during its downward travel so that movement of die 34 is arrested at a predetermined point relative to the anvil 38. Cooperating with the support table 384 is a secondary or slow-speed squeezing means 42 for moving the die 36 toward the arrested die plate 34 located in enagement with the stop 40. The slow-speed means 42 is employed to further determine the flow characteristics of the restriction 12 of the tube 10. To this end, the secondary squeezing means 42 includes a drive member 44 which is connected to a wedge-shaped member 46 through element 48.

In operation, when the drive member 44 is activated it forces the member 38 through element 48 to the left in FIG. 3. This lateral movement of the member 38 is effective through its inclined surface 50 acting on a mating surface on table 38 to raise the die 36 toward die plate 34. The element 48 may be driven by a screw that is rotatably arranged between drive 42 and wedge 46.

There is shown a means 52 for controlling operation of the slow-speed step so that the restriction formed in portion 12 is within predetermined design limits. In the present control means, a supply of fluid or air under pressure is directed into the tube 10 for controlling the final squeezing of portion 12. Fluid or air under regulated pressure is conducted from a source (not shown) to a common pressure regulator 54. The discharge side of the regulator 54 is connected to a pressure or flow switch 56. The rate of air flow may be preset and controlled by the flow switch 56. From flow switch 56 air is directed to the tubing 10 through a gauge 58 which in the present instance provides a visual indication of the fluid pressure.

The flow switch 56 is connected to the secondary squeezing mechanism 42 whose operation is initiated by the switch 56 after the passageway in portion 12 is initially decreased by movement of ram 32 of the first or high-speed operation. The flow switch 56 can be appropriately calibrated to initiate the second squeezing mechanism 42 when the pressure of the fluid in the portion 12 reaches a first predetermined pressure or after the ram 32 and die 34 are positioned by stop 40 relative to die 36.

Figure 5:
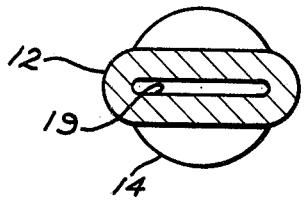
FIG. 5 is a sectional view taken along line 5—5 of FIG. 4.
Figure 4:
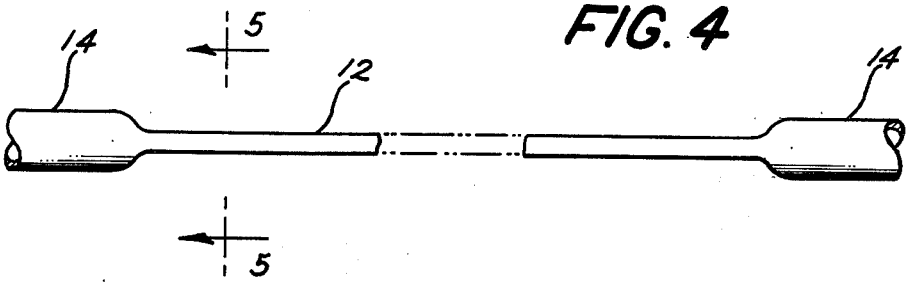
FIG. 4 shows the restrictor at its intermediate stage of fabrication.

It should be noted that in carrying out the first step of the present method of forming a squeezed portion 12 in the tube 10 as shown in FIG. 4 the second or slow-speed, while desirable in some instances, is not necessary in carrying out the present invention. In any case the passageway 19 shown in FIG. 5 of the portion 12 is formed to provide a selected predetermined refrigerant flow characteristic.

In the second step of the present method, the portion 12 is bent around a radius "A" by any suitable means to provide an arcuate segment 60 having diverging leg members 62 extending therefrom to provide a substantially U-shaped restrictor. It should be noted that the second step of forming the U-shaped restriction can be carried out while the tube 10 is connected to the fluid source so that the flow through the restrictor passageway in the arcuate segment 60 can be monitored as it is formed to provide a predetermined flow characteristic. The end portion 14 may be bent as shown in FIG. 1 around a radius "B" to provide arcuate portions 66 adjacent end portions 14 so that the end portions 14 may be conveniently connected as shown in FIG. 2 to a refrigeration system 16.

Figure 6:
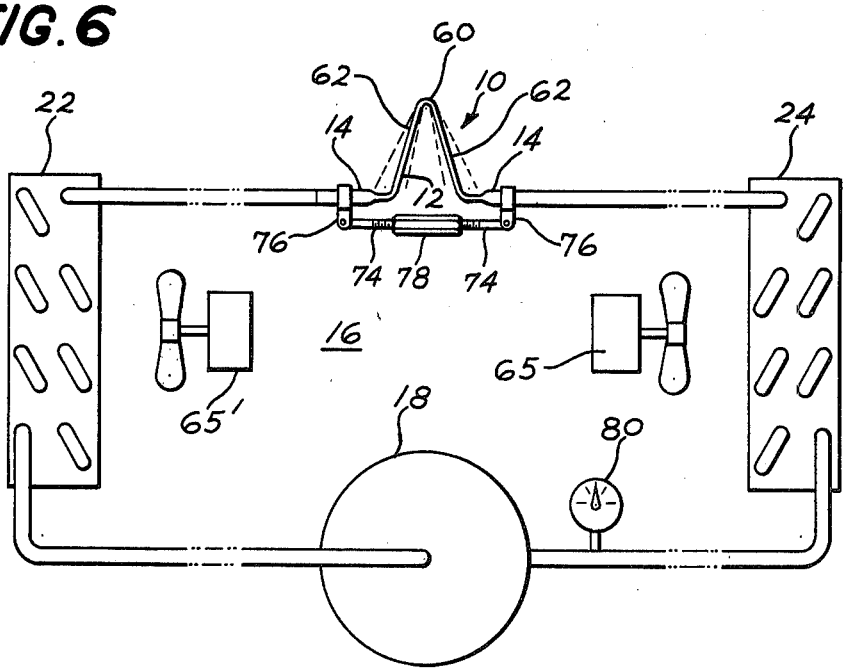
FIG. 6 is a schematic of a refrigeration system incorporating another embodiment of the present invention.

In another embodiment shown in FIG. 6, the leg members 62 are shown with means for manually moving and positioning them relative to each other. To this end, adjusting means comprising a turnbuckle type arrangement 72 is employed. Rod members 74 are secured at their one end to respective end portions 14 of the restrictor 10 by suitable brackets 76. The other end of the rods 74 are threaded and arranged in a threaded member 78. The threads are fabricated so that rotation of member 78 causes rod members 74 to either be screwed in a direction into or out of the member 78 and accordingly cause movement of leg members 62 relative to each other.

While the exact mechanism or means for forming the U-shaped restrictor 10 is not critical in carrying out the present invention, it is necessary that the desired flow through passageway 19 in the arcuate segment area 60 and arcuate portions 55 be maintained during the bending operation. It was found that when radius "A" and radius "B" are between 1.0 inches (25.4 MM) and ¼ inch (6.3 MM) that the passageway 19 in arcuate areas 60 and 66 provide the desired flow characteristics.

In accordance with the present invention, the restrictor 10 provides means for fine tuning the refrigerant flow between the high and low side of a sealed refrigeration system after the system is completely assembled and installed as part of a completed self-contained air conditioning unit. To this end the air conditioning unit including the customary fans 65 and 65' for moving air through the evaporator 24 and condenser 22, respectively, is placed in its operating mode prior to making a final refrigerant flow adjustment, as will be explained hereinafter.

Accordingly, as will be explained hereinafter in detail, means are provided to monitor the flow of refrigerant at a selected point or location in the refrigeration system while, as explained hereinafter, the air conditioning unit is operating so that the adjustments made in the refrigerant flow through the restrictor passageway 12 is determined by the condition of the refrigerant flow at the selected point being monitored.

With the U-shaped restrictor 10 connected into the refrigeration system, as shown in FIG. 2, the present invention provides means for adjusting the flow of refrigerant through the passageway 19 by altering the radius "A" of the arcuate segment 60 so that saturation conditions throughout the entire evaporator 24 at all loads is maintained while permitting the suction line to superheat in order to prevent flooding of the compressor 18.

To this end, in one embodiment, a thermistor 68 is exposed to refrigerant temperature in the suction line intermediate the evaporator and compressor. The thermistor 68 is placed in electrical control of a bimetal band or strip 70 so that current input to the bimetal 70 is a function of thermistor resistance, which in turn is a factor of refrigerant condition or temperature. The bimetal 70 is arranged on and secured to the restrictor 10 in the apex area adjacent the arcuate segment 60 as shown in FIGS. 1 and 2, and accordingly movement of the bimetal relative to current input will, in effect, cause movement of one leg member 62 relative to the other, as indicated in dotted lines in FIG. 2.

Exposure to gaseous or superheated refrigerant temperature in the suction line permits the thermistor 68 to self-heat, thereby lowering its resistance ad accordingly increase the current input to the bimetal 70. The heated bimetal 70 expands or tends to straighten out and in doing so moves the leg members 62 away from each other, as indicated in dotted line in FIG. 2, causing an increase in the cross-sectional area of passageway 19 in the segment area 50, thereby causing an increase in refrigerant flow therethrough. This heating and modulation of bimetal 70 will continue until saturation suction conditions are present. When the thermistor 68 senses wet or liquid refrigerant the thermistor will cool, increasing its resistance and causing bimetal 70 to contract or tend to coil and in doing so move the leg members toward each other, causing a decrease in the cross-sectional area of passageway 19 in the segment area 50 thereby decreasing the refrigerant flow therethrough.

In order to relate movement of the leg members to refrigerant flow in the suction line, a gauge 80 indicating temperature or pressure is arranged in the suction line. The member 78 is then rotated to move the leg members 62 and alter the cross-sectional area of passageway 19 in the arcuate segment area 50 until a desired temperature pressure is indicated on gauge 80.

In summary, by the present invention there is provided a restrictor wherein the cross-sectional area of its passageway may be altered so that refrigerant flow therethrough may be adjusted to the needs of the refrigeration system. The means for carrying out the adjustment can be manual, as in the instance of FIG. 6, either during the manufacturing process or during a service call. In the alternative, the adjustment can be carried out automatically and continuously as the needs of the refrigeration system demands as shown in FIG. 2. It should be noted that other systems may be employed to physically move the leg member 62 relative to each other to accomplish the desired flow characteristics of the refrigerant.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

What is claimed is:

1. The method of forming a capillary tube for use in a refrigeration system including refrigerant which comprises:

forming a length of tubing longitudinally into a preselected configuration so that the free ends thereof are arranged to connect with said refrigeration system, including at least one portion intermediate said ends being in a single plane;

placing said portion of said tubing intermediate said free ends in a forming means;

connecting at least one of said free ends to a source of constant pressure through a control means having means for measuring said pressure passing through said tubing;

squeezing said portion of the tubing in the forming means until the tubing reaches an intermediate predetermined restriction; then bending said portion to provide a generally U-shaped restriction having leg members diverging from an arcuate apex segment and having arcuate segments at the juncture of each of said leg members with said tubing;

connecting said tubing including said portion in refrigerant flow arrangement in said refrigeration system and operating said system;

moving at least one of said leg members relative to the other to change the diameter of at least one of said arcuate portions while said refrigerant system is operating to fine tune the refrigerant flow through said capillary until the restriction causes refrigerant passing through said tubing to reach a final predetermined pressure.

2. The method of claim 1 wherein the step includes monitoring the flow of refrigerant in said system while moving at least one of said leg members.

* * * * *